US005915641A

United States Patent [19]

Barberg

[11] Patent Number: 5,915,641

[45] Date of Patent: Jun. 29, 1999

[54] REEL INSIDE BUCKET

[75] Inventor: Daniel A. Barberg, Cokato, Minn.

[73] Assignee: Reel-A-Pail, Inc., Cokato, Mich.

[21] Appl. No.: 08/325,549

[22] Filed: Oct. 18, 1994

Related U.S. Application Data

[63] Continuation of application No. 08/064,945, May 20, 1993, abandoned, which is a continuation-in-part of application No. 08/049,733, Apr. 19, 1993, abandoned.

[51] Int. Cl.[6] ..... B65H 75/30; B65H 75/38; B65H 75/44; H02G 11/00

[52] U.S. Cl. ..... 242/395.1; 242/400; 242/405; 242/405.3; 242/406; 242/588.6; 191/12.2 R

[58] Field of Search ..... 242/85, 86, 96, 242/106, 129, 139, 388, 388.5, 395, 395.1, 405, 405.3, 406, 588.6, 400; 191/12.2 R, 12.2 A

[56] References Cited

U.S. PATENT DOCUMENTS

| | | | |
|---|---|---|---|
| 4,015,795 | 4/1977 | Chong | 242/388 |
| 4,244,536 | 1/1981 | Harrill | 242/96 |
| 4,384,688 | 5/1983 | Smith | 191/12.2 R X |
| 4,442,984 | 4/1984 | Bayat | 242/106 |
| 4,520,239 | 5/1985 | Schwartz | 242/96 X |
| 4,529,146 | 7/1985 | Nederman | 242/106 X |
| 4,787,168 | 11/1988 | Benit et al. | 242/106 X |

*Primary Examiner*—John Q. Nguyen
*Attorney, Agent, or Firm*—Kinney & Lange, P.A.

[57] ABSTRACT

A device for storing and managing an elongate flexible member having a first end and a second end includes a container, a spool, a foot plate, a retainer, and a knob. The container includes a base, a sidewall, and a first access hole. The spool is disposed within the container and includes a bottom, a top having a second access hole, and a column between the top and the bottom. The column defines a surface for wrapping the length of flexible member around so that the second end of the flexible member passes through the second access and so that the first end of the flexible member passes through the first access hole of the container. The foot plate is secured to the base of the container and includes mounting holes which extend through the foot plate. The retainer is coupled to the container and holds the spool within the container. The knob is coupled to the top of the spool and permits rotation of the spool within the container.

25 Claims, 7 Drawing Sheets

REEL INSIDE BUCKET

This is a continuation of application Ser. No. 08/064,945, filed May 20, 1993 now abandoned, which is a continuation-in-part of application Ser. No. 08/049,733, filed Apr. 19, 1993, now abandoned, and entitled REEL INSIDE BUCKET.

BACKGROUND OF THE INVENTION

The invention relates to containers and devices for storing and managing lengths of flexible elongate members. In particular, the invention relates to devices having a spool disposed within a container where, upon rotation of the spool, a length of a flexible elongate member is wrapped around the spool.

Flexible elongate members, in a variety of forms, fulfill a multitude of functions. Examples include electric cords, speaker or other wires, air hoses and water hoses. Unfortunately, flexible elongate members are inherently lengthy and bulky. As a result, flexible elongate members are difficult to organize, manage and protect.

SUMMARY OF THE INVENTION

The present invention is a device for storing and managing a flexible elongate member having a first end and a second end. The device includes a container, a spool, a bearing unit, a knob, a foot plate and a retainer. The container has a base, a side wall and a first access hole. The spool is disposed within the container. The spool has a top, a bottom, a second access hole and a column extending between the top and the bottom of the spool. The bearing unit is positioned between the bottom of the spool and the base of the container to rotatably support the spool above the base of the container. The knob is secured to the top of the spool. The foot plate is secured to the base of the container. The foot plate includes mounting holes which extend through the foot plate. The retainer is coupled to the container and holds the spool within the container.

In operation, the first end of the flexible member passes through the first access hole of the container. The second end of the flexible elongate member passes through the second access hole of the container. Rotation of the crank causes the length of flexible elongate member to be taken up through the second access hole of the container and to be wrapped around a surface of the spool within the container. Alternatively, opposite rotation of the crank permits the length of the flexible elongate member to be unwrapped from the spool to increase the length of flexible elongate member extending beyond the second access hole of the container. The mounting holes permit the device to be mounted to a wall. The retainer holds the spool within the container. As a result, the present invention stores and neatly manages the length of the flexible elongate member adjacent a wall or other similar structure.

An alternate embodiment of the present invention includes a container, a spool, and an electrical bearing unit. The container has a base, a side wall and a first access hole. The spool is disposed within the container and includes a bottom, a top and a column between the top and the bottom. The column defines a surface for wrapping a length of electrical cord around. The first end of the electrical cord passes through the first access hole of the container. The electrical bearing unit includes a top bearing member, at least one top bearing race, a bottom bearing member, at least one bottom bearing race, bearing balls, a first electrical member and a second electrical member. The top bearing member is coupled to the bottom of the spool. The top bearing race is coupled to a bottom surface of the top bearing member. The bottom bearing member is coupled to the base of the container. The bottom bearing race is coupled to a top surface of the bottom bearing member. Both the top bearing race and the bottom hearing race are made of electrically conductive material. The bearing balls are rotatably fitted between the top bearing race and the bottom bearing race and are made of electrically conductive material. The first electrical member is electrically coupled to the bottom bearing race. The second electrical member electrically coupled to the top bearing race. The first electrical member has a terminal exposed outside of the container. The second electrical member has a terminal exposed above the bottom of the spool. As a result, the second end of the electrical cord may be electrically coupled to the second electrical member to create an electrical circuit between the first end of the electrical cord and the first electrical member.

DETAILED DESCRIPTION OF THE PREFERRED EMBODIMENTS

Figure 1:
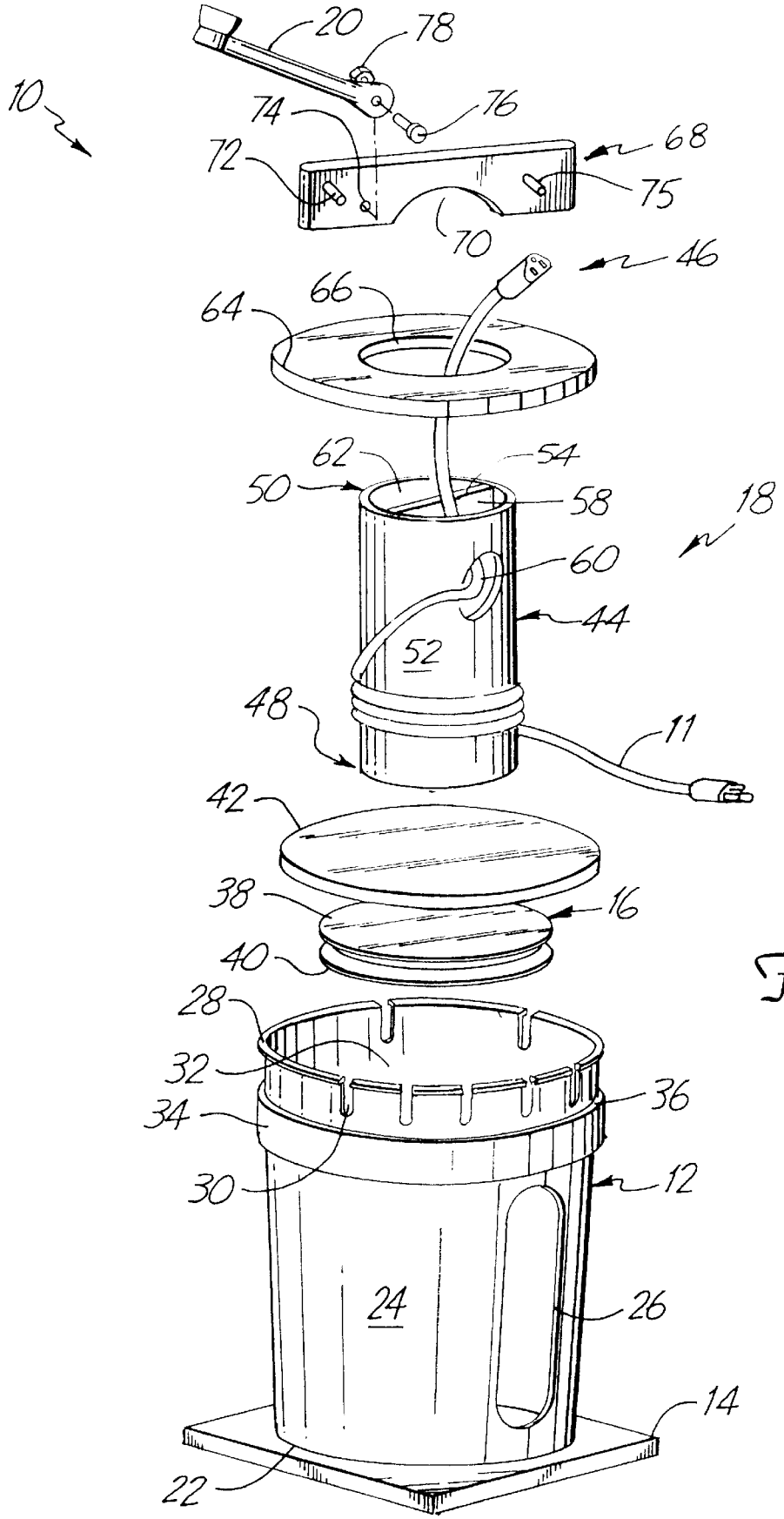
FIG. 1 is an exploded perspective view of a pail reel of the present invention.

FIGS. 1 is an exploded view of pail reel 10 used for managing and protecting an elongate flexible member 11, such as a cord, a wire, or a hose. FIG. 1 shows that pail reel 10 includes container or bucket 12, foot plate 14, bearing unit 16, spool 18 and crank 20. Bucket 12 includes base 22, side wall 24, slotted access hole 26, rim 28, slits 30 and interior 32. Side wall 24 extends upward from base 22 and terminates to form rim 28. Side wall 24 includes collar 34. Side wall 24 is preferably cylindrical. However, side wall 24 may have a variety of shapes. Towards rim 28, side wall 24 bulges outward away from interior 32 to form collar 34 having shoulder 36. Access hole 26 is elongated and extends from its lower end near base 22 to its upper end near rim 28. Access hole 26 extends through side wall 24 into interior 32. Interior 32 is defined by base 22, side wall 24 and rim 28. Slits 30 extend downward from rim 28 into side wall 24. Base 22 is secured to foot plate 14.

Bucket 12 houses and protects bearing unit 16, spool 18, crank 20 and elongate flexible member 11 wrapped around spool 18. Base 22 of bucket 12 provides a surface for supporting bearing unit 16 and spool 18. Side wall 24 houses and protects bearing unit 16, spool 18, crank 20 and whatever contents are placed within interior 32 of bucket 12. Access hole 26 and side wall 24 provide an access by which an end of elongate flexible member 11 passes through. Because access hole 26 extends substantially from base 22 to near rim 28, elongate flexible member 11 can be easily accessed.

Slits 30 allow an end of elongate flexible member 11 to be releasably secured to bucket 12. Slits 30 prevent the ends of elongate flexible member 11 from becoming wound within bucket 12. In addition, slits 30 support the ends of elongate flexible member 11 above foot plate 14 and above the ground. As a result, slits 30 prevent the ends of the flexible member 11 from being run over, stepped on or damaged while permitting easy access to the ends of elongate member 11. When pail reel 10 is used for storing and managing electrical cords, slits 30 prevent the cords from becoming unplugged when in use. Collar 34 and shoulder 36 provide a surface for supporting a belt or ring attachment which may be secured around bucket 12 below rim 28.

Foot plate 14 generally consists of a flat plate. Foot plate 14 is secured to base 22 of bucket 12. Foot plate 14 balances and stabilizes bucket 12.

Bearing unit 16 is housed within interior 32 of bucket 12 and rests upon base 22 of bucket 12. Bearing unit 16 is well known and includes a top race 38, a bottom race 40 and an annular array of bearing balls (not shown). As is known in the art, top race 38 cooperates with bottom race 40 to house and contain the annular array of bearing balls between top race 38 and bottom race 40. Bottom race 40 rests upon base 22 within interior 32 of bucket 12. Top race 38 is secured to spool 18. Top race 38 rotates relative to bottom race 40. As a result, bearing unit 16 rotatably supports spool 18 above base 22 of bucket 12, permitting spool 18 to rotate so as to permit the flexible member 11 to wind and unwind around spool 18. Alternatively, other types of bearing devices, as are well known in the art, may he used to rotatably support spool 18 above base 22. For example, spool may frictionally rotate above base 22.

Spool 18 is housed within interior 32 of bucket 12 and includes bottom spool plate or disk 42, tube or column 44 and top plate or disk assembly 46. Bottom disk 42 is generally flat and circular in shape. Bottom disk 42 has a circumference greater than a circumference of column 44. However, bottom disk 42 has a circumference sufficiently small enough to permit bottom disk 42 to rotatably fit within interior 32 of bucket 12. Bottom disk 42 is secured to top race 38 of bearing unit 16. Bottom disk 42 provides a bottom surface for supporting the elongate flexible member 11. Bottom disk 42 also prevents the elongate flexible member 11 from coming into contact with bearing unit 16.

Column 44 is secured between bottom disk 42 and top disk assembly 46 and includes bottom end 48, top end 50 and surface wall 52. Surface wall 52 extends from bottom end 48 to top end 50. Bottom end 48 is coupled to bottom disk 42. Top end 50 is coupled to top disk assembly 46. Surface wall 52 defines a surface for wrapping the elongate flexible member 11 around. Aperture 60 provides an entrance by which an end of flexible member 11 enters a cavity in column 44 so as to extend through top disk assembly 46. Column 44 also supports top disk assembly 46.

Top disk assembly 46 is secured to top end 50 of column 44 and includes top disk 64, top access or exit hole 66 and brace 68. Top disk 64 is preferably circular and has an outer diameter greater than the outer diameter of column 44, but small enough so as to fit within interior 32 of bucket 12. Top access hole 66 is centered within, and extends through, top disk 64. Top access hole 66 preferably has a circumference similar to a circumference of column 44. Top disk 64 is secured to top 50 of column 44. Top disk 64 defines an upper surface for containing the flexible member 11 within bucket 12. Top access hole 66 communicates with the cavity in column 44. Consequently, an end of flexible member 11 may extend from the cavity through top access hole 66 and out the top end of pail reel 10. Top access hole 66 also permits access to interior compartment 62 so that tools, parts or other items may be stored within compartment 62.

Brace 68 is generally rectangular and includes arcuate edge 70, support dowel 72, bore 74 and support pin 75. Arcuate edge 70 is centered along a bottom edge of brace 68. Arcuate edge 70 arcs so as to extend across top access hole 66. Support dowel 72 is secured to a side of brace 68 and extends outward from brace 68. Brace 68 is secured to a top of top disk 64 so that arcuate edge 70 extends over the top access hole 66. Arcuate edge 70 permits an end of the flexible member 11 to extend through top access hole 66 and past brace 68. Brace 68 rigidifies top disk 64 and provides a surface to which crank 20 is mounted.

Crank 20 is mounted to brace 68 by bolt 76 and nut 78. Bolt 76 extends through crank 20 and through bore 74 to threadably engage nut 78. Support pin 75 is secured to the side of brace 68 and extends outward from brace 68. Support pin 75 is positioned across arcuate edge 70 opposite support dowel 72. Crank 20 rotates around bolt 76 to a first position and a second position. In the first position, crank 20 engages support dowel 72 and extends above brace 68 out of bucket 12. In the second position, crank 20 is retracted and rests upon support pin 75 adjacent brace 68 and within bucket 12. As a result, crank 20 may be rotated so as to extend out of bucket 12 to permit the manual rotation of spool 18. When not in use, crank 20 may be rotated and retracted so as to rest upon support pin 75 within bucket 12.

Figure 2:
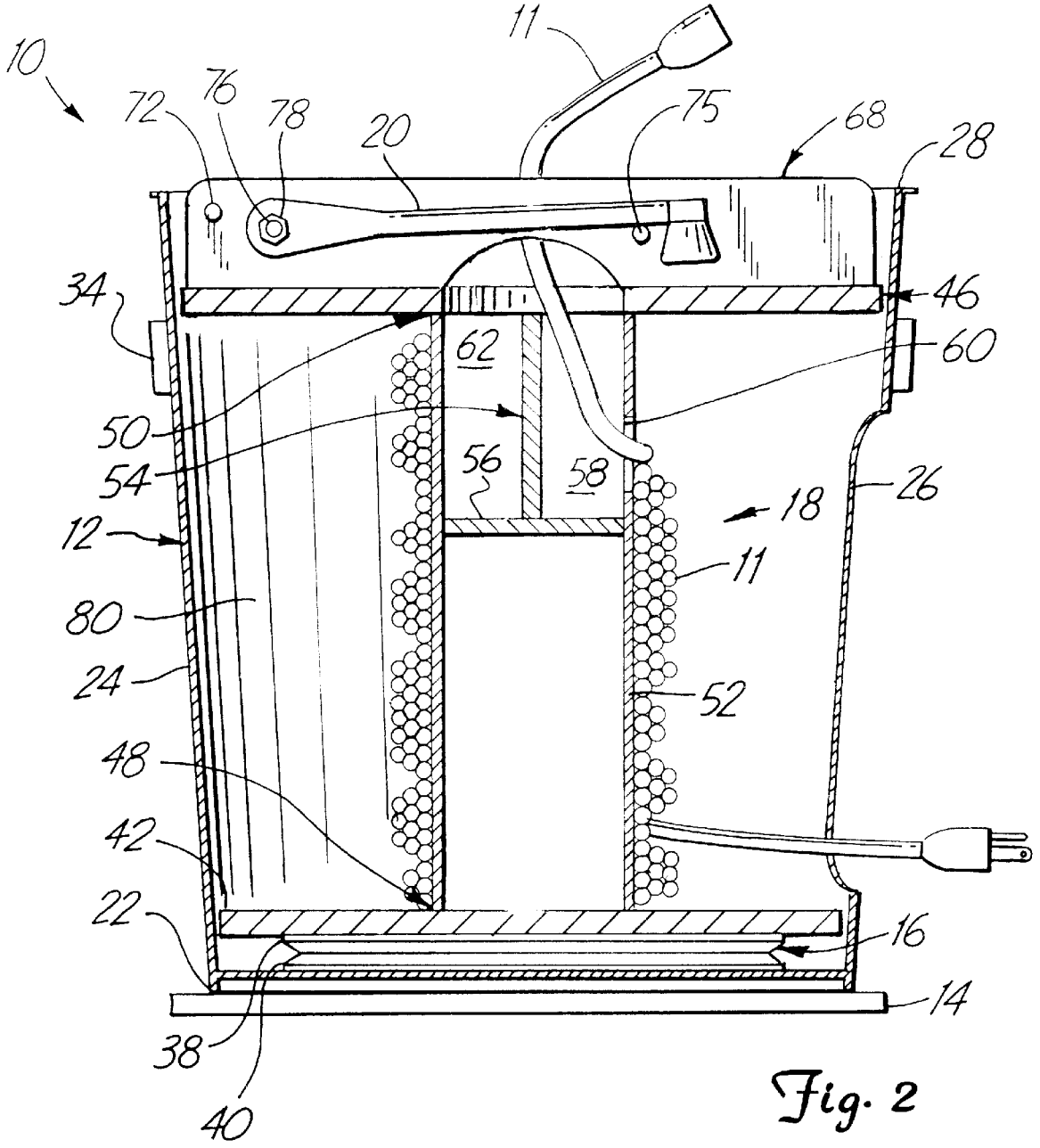
FIG. 2 is a cross-sectional view of the pail reel of FIG. 1.

FIG. 2 shows a cross-sectional view of assembled pail reel 10. FIG. 2 shows column 44 and spool 18 in further detail. FIG. 2 also better shows elongate flexible member 11 having a length which wraps around surface 52 of column 44, an end which extends and passes through access hole 26 of side wall 24 and an opposite end which passes through top access hole 66 above rim 28 and brace 68.

As shown in FIG. 2, foot plate 14 supports bucket 12. Bearing unit 16 rests within bucket 12 and rests upon base 22 of bucket 12. Spool 18 fits within bucket 12 and is coupled to bearing unit 16. Crank 20 is coupled to brace 68 of spool 18.

As shown in detail by FIG. 2, column 44 of spool 18 includes divider wall 54, intermediate floor 56, cavity 58, aperture 60 and storage compartment 62. Column 44 is preferably cylindrical or tubular in shape and is defined by surface wall 52. Divider wall 54 longitudinally intersects a center of column 44. Intermediate floor 56 horizontally extends across column 44. Divider wall 54, intermediate floor 56 and surface wall 52 define interior cavity 58 and interior compartment 62. Aperture 60 extends through surface wall 52 into cavity 58. Divider wall 54 separates cavity 58 from compartment 62. Compartment 62 permits tools, parts and other accessories to be stored within column 44. Cavity 58 permits an end of elongate flexible member 11 to extend through access hole 66 and above pail reel 10.

FIG. 2 shows that pail reel 10 neatly manages and protects elongate flexible member 11. An end of elongate flexible member 11 passes through access hole 60, cavity 58 and top access hole 66 beneath arcuate edge 70 and out above bucket 12. A length of flexible member 11 is wrapped around surface wall 52 of column 44. Top disk 64, surface wall 52, bottom disk 42 and side wall 24 define a wrap area 80 within interior 32 of bucket 12. Wrap area 80 permits a substantial length of flexible member 11 to be wrapped around column 44 of spool 18. An opposite end of flexible member 11 passes through elongate access hole 26 and out of bucket 12.

In operation, rotation of crank 20 causes flexible member 11 to be taken up through access hole 26 of bucket 12 and to be wrapped around surface wall 52 of spool 18 within bucket 12. Alternatively, opposite rotation of crank 20 causes flexible member 11 to be unwrapped from spool 18 to increase the length of flexible member 11 extending beyond access hole 26 and out of bucket 12. Consequently, pail reel 10 stores and neatly manages flexible member 11.

Figure 3:
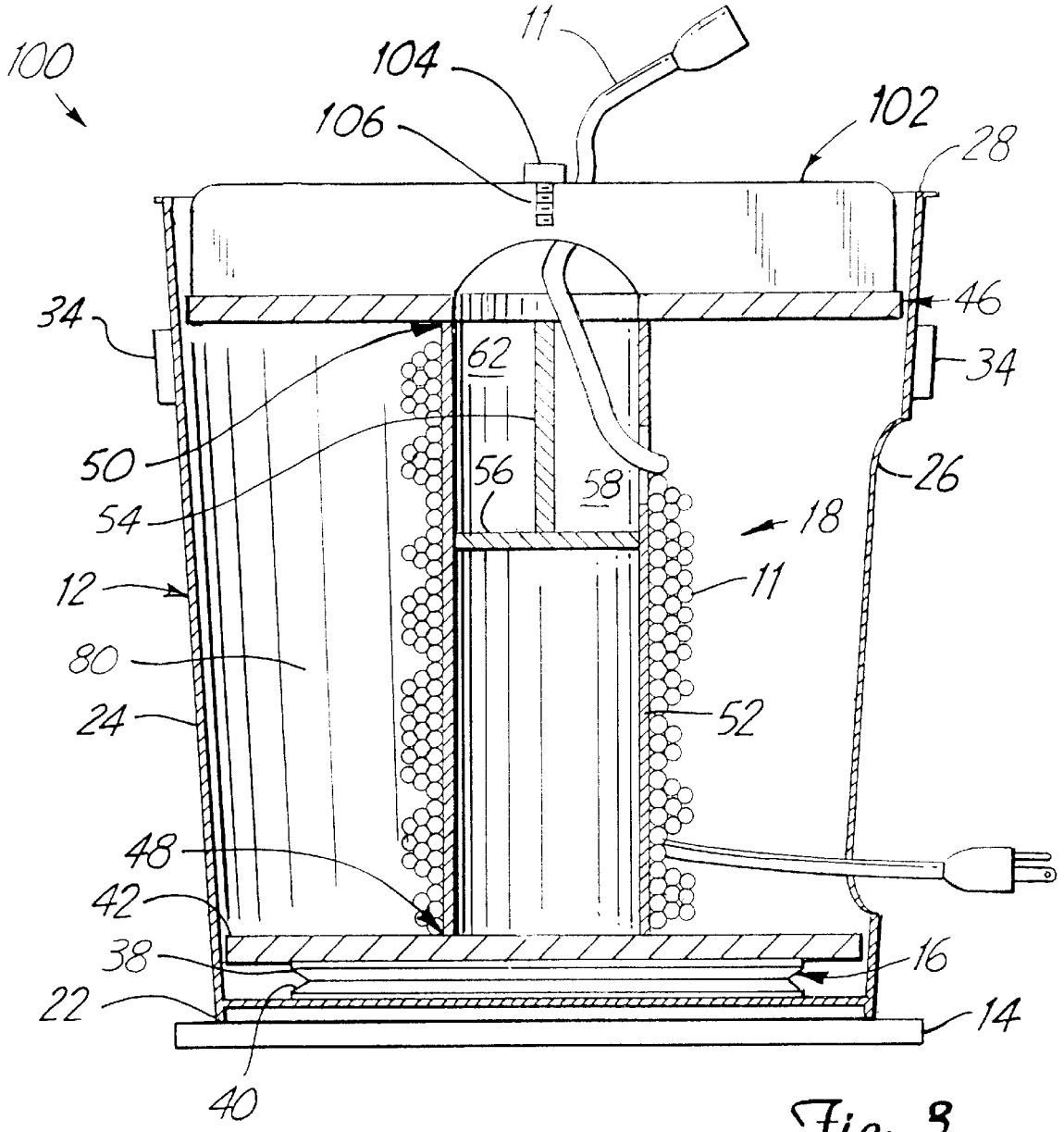
FIG. 3 is a cross-sectional view of an alternate embodiment of the pail reel of FIGS. 1 and 2.

FIG. 3 shows a cross sectional view of an alternate embodiment 100 of pail reel 10. For the sake of illustration, those elements of pail reel 100 which are the same as corresponding elements of pail reel 10 are numbered similarly. Pail reel 100 is similar to pail reel 10 except that brace 68 of pail reel 10 is replaced with brace 102, and crank 20 of pail reel 10 is replaced with bolt 104. Brace 102 is similar to brace 68 of pail reel 10 except that brace 102 does not include support dowel 72, bore 74, and support pin 75. Brace 102 further includes threaded bore 106. Threaded bore 106 is centered across a top surface of brace 102 above arcuate edge 70. Bolt 104 has threads which threadably engage threaded bore 106. In this way, bolt 104 is fixably secured to brace 102. Bolt 104 permits spool 18 to be rotated by connection to, and activation of, an automatic or manually operated nut driver or nut runner. Consequently, spool 18 can be easily operated to quickly wind up flexible member 11 around column 44 of spool 18.

Figure 4:
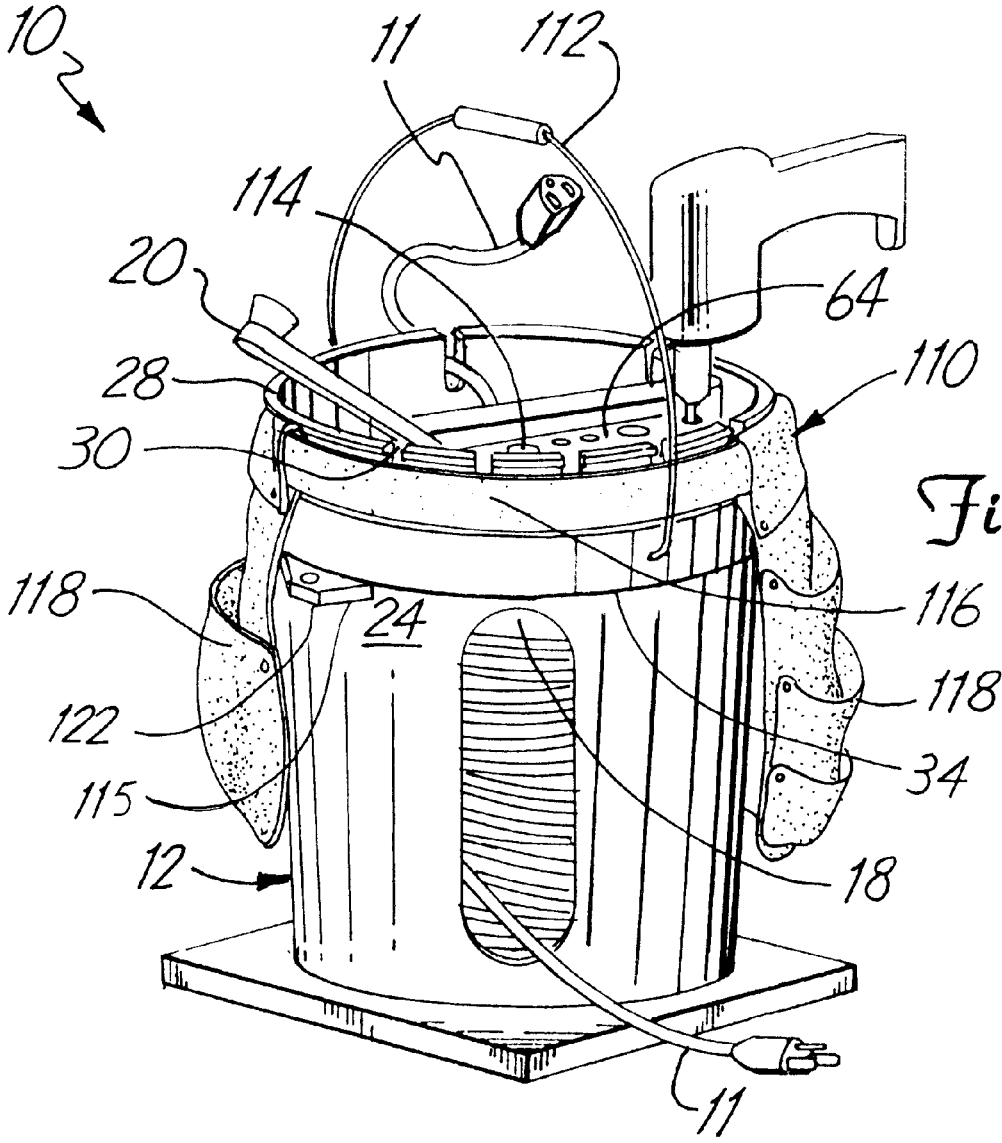
FIG. 4 is a perspective view of the pail reel of FIGS. 1 and 2 with attachments mounted thereon.

FIG. 4 shows a perspective view of pail reel 10 with flexible member 11 wrapped around spool 18 within bucket 12. Pail reel 10 also includes several additional attachments, such as apron 110, handle 112, tool slots 114 and ring attachment 115. Apron 110 includes belt 116 and pockets 118. Belt 116 encircles side wall 24 of bucket 12 above collar 34. Collar 34 supports belt 116 below rim 28. Pockets 118 are secured to belt 116 and hang down from belt 116. Pockets 118 permit the storage and transport of tools and parts.

Handle 112 arcuately extends above rim 28 of bucket 12. Handle 112 is secured at both ends to collar 34 of bucket 12. Handle 112 permits easy handling and transport of pail reel 10.

Tool slots 114 extend through top disk 64. Tool slots 114 have a variety of shapes and sizes which permit the storage and transport of a variety of tools and parts.

Ring attachment 115 includes aperture 122. Aperture 122 extends through ring attachment 115. Ring attachment 115 is fixedly secured to sidewall 24 by plastic welding. Alternatively, screws may be used to secure ring attachment 115 to sidewall 24. Ring Attachment 115 permits pail reel 10 to be hung from a hook or similar structure. Ring attachment 115 may also be used to support tools.

Figure 5:
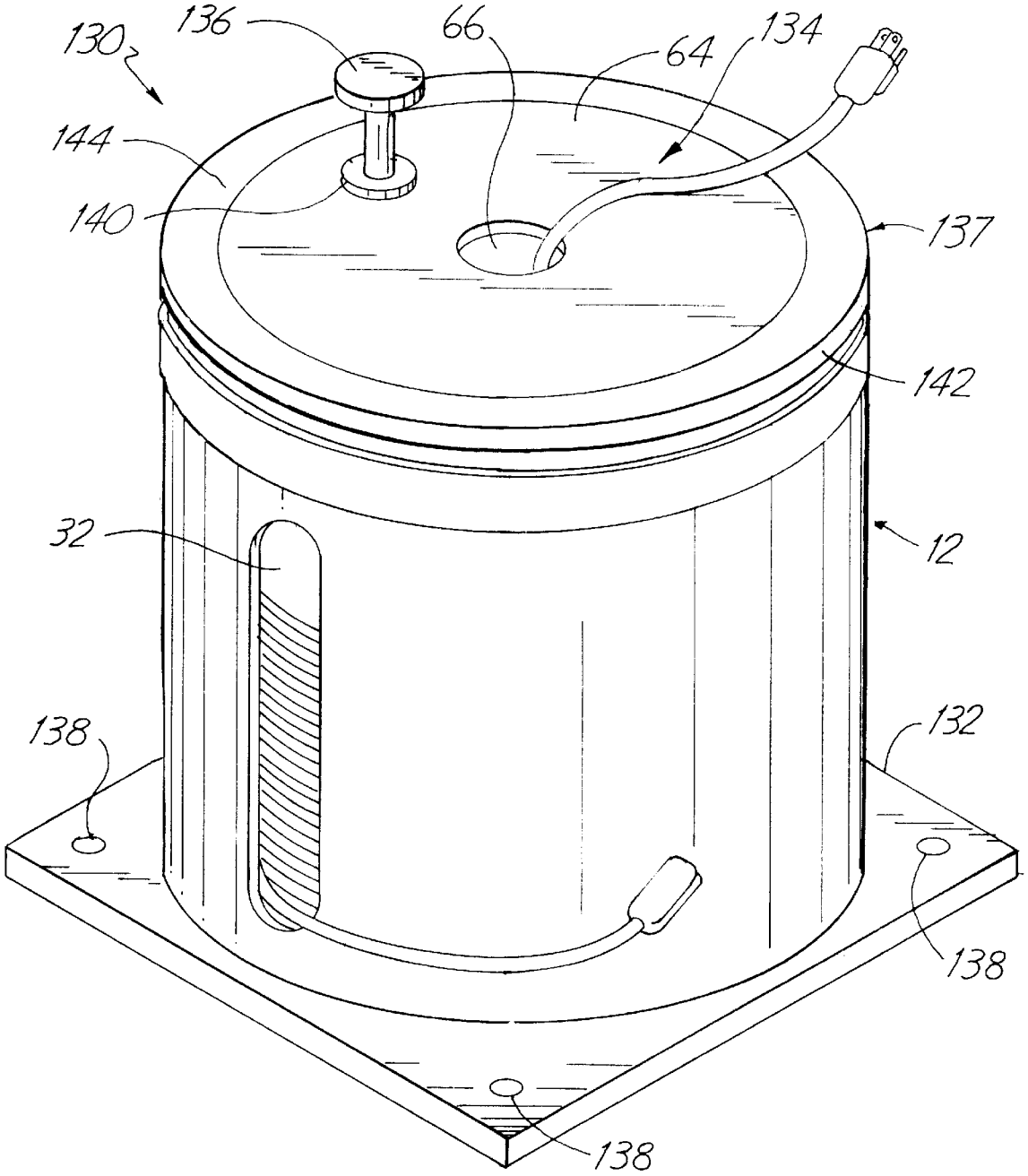
FIG. 5 is a perspective view of an alternate embodiment of the pail reel shown in FIGS. 1 and 2.

FIG. 5 shows a perspective view of an alternate embodiment 130 of pail reel 10. For sake of illustration, those elements of pail reel 130 which are the same as the corresponding elements of pail reel 10 are numbered similarly. Pail reel 130 is similar to pail reel 10 except that foot plate 14 is replaced with foot plate 132, spool 18 is replaced with spool 134, and crank 20 is replaced with crank or knob 136. Pail reel 130 further includes retainer 137.

Foot plate 132 is similar to foot plate 14 except that foot plate 132 further includes mounting holes 138. Mounting holes 138 are preferably positioned at corners of foot plate 132 and extend through foot plate 132. Mounting holes 138 permit pail reel 130 to be mounted on a wall by hooks, bolts or screws.

Spool 134 is similar to spool 18 of pail reel 10 except that spool 134 excludes brace 68. Spool 134 fits entirely within interior 32 of bucket 12.

Knob 136 is mounted to top disc 64 of spool 134 by screws 140. Knob 136 is positioned between top access hole 66 and retainer 137. Knob 136 extends above retainer 137. Knob 136 permits manual rotation of spool 134.

Retainer 137 is generally ring-shaped and includes locking rim 142. Locking rim 142 and overlapping edge 144 surrounds and engages rim 28 of bucket 12. Overlapping edge 144 extends from rim 142 toward the center of bucket 12. Overlapping edge 144 overlaps top disc 64 of spool 134 and holds spool 134 within interior 32 of bucket 12. At the same time, retainer 137 permits manual rotation of knob 136 and permits spool 134 to be rotated within bucket 12.

Figure 6:
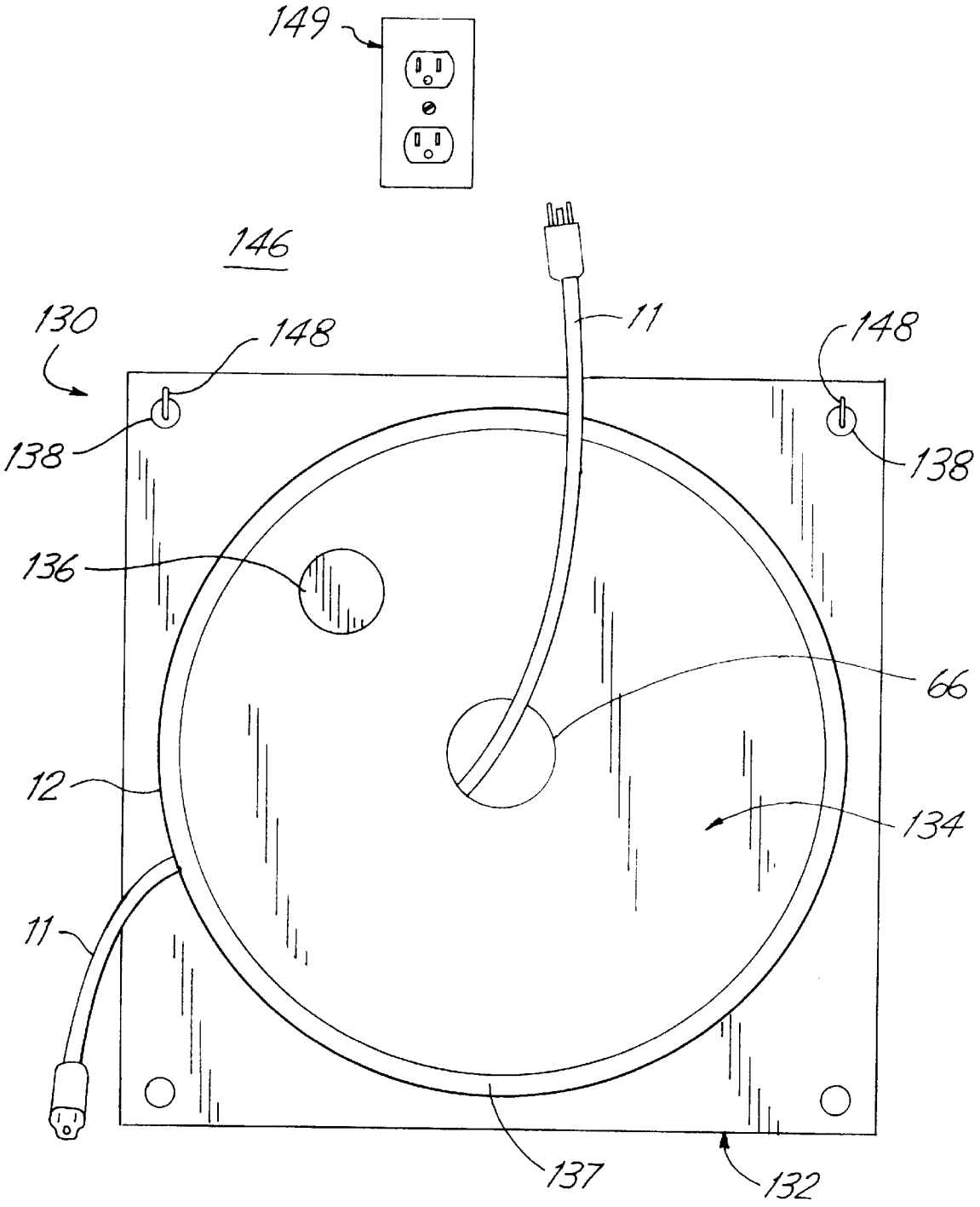
FIG. 6 is a side elevational view of the pail reel shown in FIG. 5 mounted to a wall.

FIG. 6 shows a top elevational view of pail reel 130 mounted to a wall 146 by hooks 148. As best shown by FIG. 6, pail reel 130 is mounted adjacent wall 146 by hooks 148. Hooks 148 are fixedly secured to wall 146 and extend through mounting holes 138 of pail reel 130. In this way, pail reel 130 is mounted to wall 146 so that an end of flexible member 11 may be easily accessed through top access hole 66 and another end of flexible member 11 may extend out the side of bucket 12. When flexible member 11 constitutes an electrical cord, pail reel 130 may be mounted near an electrical outlet 149. As a result, one end of flexible member 11 may be plugged into outlet 149 while another end of flexible member 11 may be pulled through the side of bucket 112 and may be unwound from spool 134 while pail reel 130 remains mounted to wall 146.

Figure 7:
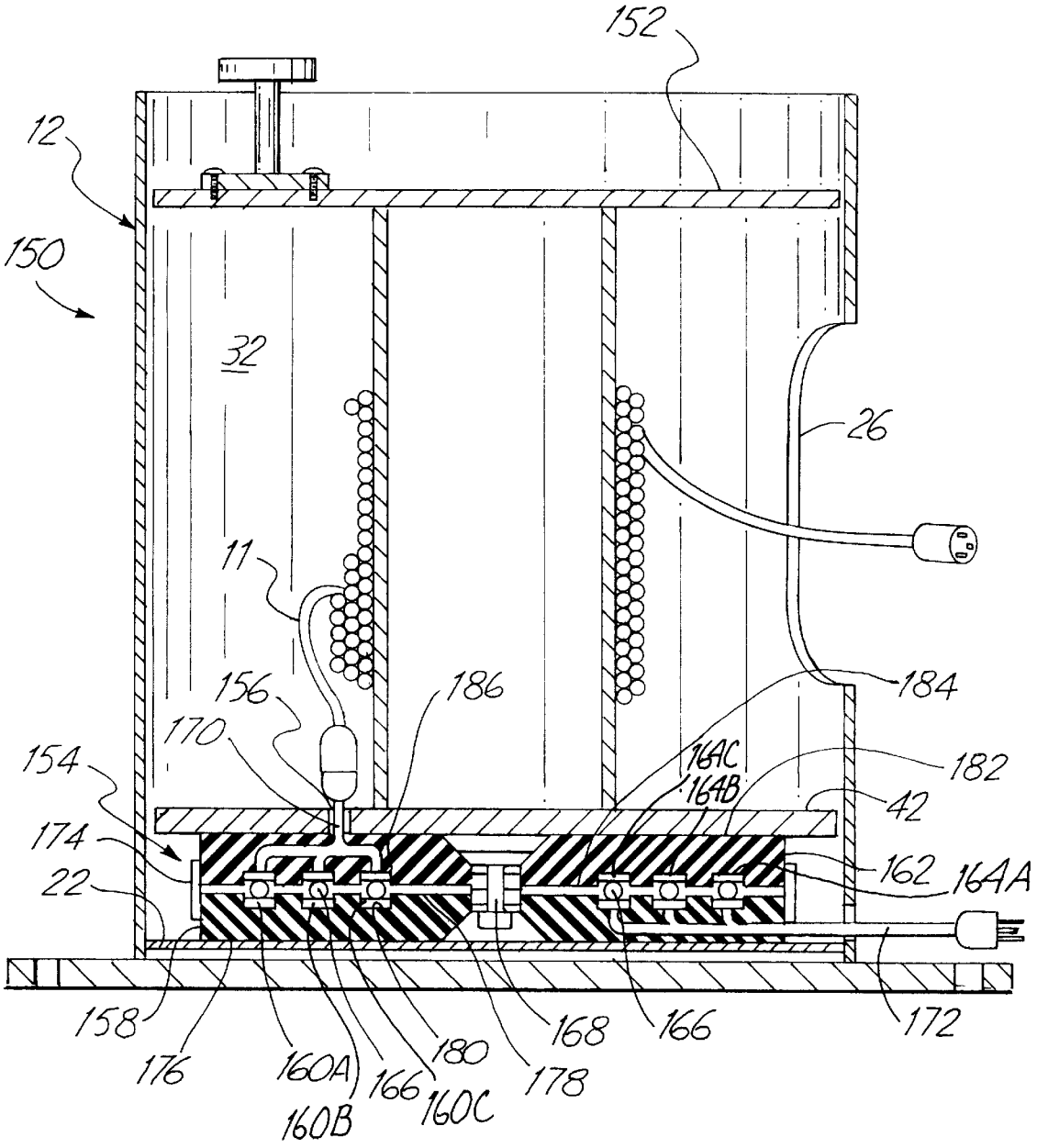
FIG. 7 is a cross sectional view of an alternate embodiment of the pail reel shown in FIG. 5.

FIG. 7 shows a cross-sectional view of an alternate embodiment 150 of pail reel 130. For sake of illustration, those elements of pail reel 150 which are the same as the corresponding elements of pail reel 130 are numbered similarly. Pail reel 150 is similar to pail reel 130 except that pail reel 150 includes spool 152 and electrical bearing unit 154. Spool 152 is similar to spool 134 of pail reel 130 except that spool 152 excludes top access hole 66. Spool 152 further includes a channel or conduit 156 extending through bottom plate 42. Spool 152 fits within interior 32 of bucket 12.

Electrical bearing unit 154 is positioned between spool 152 and base 22 of bucket 12. Electrical bearing unit 154 rotatably supports spool 152 above base 22, while at the same time, providing an electrical circuit extending from above bottom plate 42 of spool 152 to a point outside of bucket 12 towards base 22 of bucket 12.

Electrical bearing unit 154 includes bottom bearing member 158, bottom bearing races 160, top bearing member 162, top bearing races 164, bearing balls 166, central pivot 168, electrical outlet 170, electrical plug 172 and seal or gasket 174. Bottom bearing member 158 is generally disc shaped and includes bottom surface 176 and top surface 178. Bottom surface 176 is coupled to base 22 of bucket 12. Top surface 178 includes circular grooves 180. Circular grooves 180 extend into bottom bearing member 158 and house bottom bearing races 160.

Bottom bearing races 160 are positioned within circular grooves 180. Bottom bearing races 160 are preferably press fit within circular grooves 180. Bottom bearing races 160 are made of a conductive material such as brass.

Top bearing member 62 is generally disc shaped and includes top surface 182 and bottom surface 184. Top surface 182 is coupled to bottom plate 42 of spool 152. Bottom surface 184 includes circular grooves 186. Circular grooves 186 extend into top bearing member 162. Circular grooves 186 house top bearing races 164.

Top bearing races 164 are preferably press fit within circular grooves 186. Top bearing races 164 are made of an electrically conductive material such as brass.

Central pivot 168 is mounted between bottom bearing member 158 and top bearing member 162. Central pivot 168 couples bottom bearing member 158 to top bearing member 162 and provides a central pivot upon which top bearing member 162 rotates relative to bottom bearing member 158. Central pivot 168 is preferably a bolt or a pin.

Electrical outlet 170 is an electrical cord having a positive terminal, a negative terminal, and a ground. One end of electrical outlet 170 is electrically coupled to top bearing races 164. Preferably, the ground is electrically coupled to one top bearing race 164A, the positive terminal is electrically coupled to a second top bearing race 164B, and the negative terminal is electrically coupled to a third top bearing race 164C. Electrical outlet 170 extends through conduit 156 and bottom plate 42 of spool 152 to expose an electrical terminal of electrical outlet 170 above bottom plate 42. As a result, an end of electrical cord 11 may be electrically coupled to electrical outlet 170 within interior 32 of bucket 12. Alternatively, electrical outlet 170 and electrical cord 11 could be replaced with a single electrical cord having one end coupled to top bearing races 164 and having an opposite end extending out access slot 26 of bucket 12.

Electrical plug 172 preferably comprises an electrical cord electrically coupled to bottom bearing races 160. One end of electrical plug 172 preferably has a positive terminal, a negative terminal, and a ground. The ground is electrically coupled to a bottom bearing race 160A, the positive terminal is electrically coupled to a second bottom bearing race 160B, and the negative terminal is coupled to a third bottom bearing race 160C. Electrical plug 172 extends through bottom bearing member 158 and passes through bucket 12 so as to expose an electrical terminal of electrical plug 172 outside of bucket 12. As a result, a second end of electrical plug 172 may be plugged into an outlet.

Electrical bearing unit 154 creates an electrical circuit from the outside of bucket 12 near base 22 of bucket 12 through the point above bottom plate 42 of spool 152. The electrical circuit extends through electrical plug 172, bottom bearing races 160, bearing balls 166, top bearing races 164 and electrical outlet 170. This electrical circuit enables an end of electrical cord 11 to be connected to electrical outlet 170 to receive electrical power transferred from a point outside of bucket 12. As a result, electrical plug 172 may be plugged into an outlet to supply power to an electrical cord 11 wrapped around spool 152 and having only one end extending out of pail reel 150. Thus, the management and use of electrical cords is more convenient.

Seal or gasket 174 encircles bottom bearing member 158 and top bearing member 162. Gasket 174 provides a seal between bottom bearing member 158 and top bearing member 162. As a result, water and other contaminants are prevented from coming into contact with either bearing races 160, 164 or bearing balls 166.

In conclusion, the pail reel of the present invention protects, manages and neatly stores flexible member 11. The pail reel permits flexible member 11 to be easily wound and unwound around the spool within bucket 12. As force is applied to the crank, spool 18 rotates to quickly wind flexible member 11. An end of flexible member 11 extends out of the slotted access hole. An opposite end of flexible member 11 extends out of bucket 12 above rim 28. One or both ends may be releasably secured within slots to protect the ends or permit quick location of the ends. Other attachments, such as aprons or tool slots, permit the storage and transport of tools and other parts along with flexible member 11. Overall, the pail reel of the present invention neatly stores and protects elongate flexible members such as cords, hoses, wire and any other tools or accessories that may be needed with flexible member 11.

Although surface wall 52 described in the preferred embodiments has a generally circular cross-section, surface wall 52 may be constructed in a variety of shapes. For example, surface wall 52 may also have a cross-section which is X-shaped.

Although the present invention has been described with reference to preferred embodiments, workers skilled in the art will recognize that changes may be made in form and detail without departing from the spirit and scope of the invention.

What is claimed is:

1. A device for storing an elongate flexible member having a length, a first end and a second end, the device comprising:

a container having a base, a cylindrical side wall having a rim opposite the base and defining an interior of the container, and a first access hole extending through the side wall;

a spool disposed within the container, the spool comprising:

a bottom freely resting upon the base of the container, a top having a second access hole extending therethrough, and a column vertically mounted between the top and the bottom, the column having a surface for winding the length of flexible member around, wherein the second end of the flexible member passes through the second access hole and wherein the first end of flexible member passes through the first access hole of the container;

a foot plate secured to an exterior of the base of the container, the foot plate having a generally horizontal surface extending below the base of the container beyond the side wall so that force may be applied to the horizontal surface for stabilizing the device as the spool is rotated and when the spool is being removed from the container, the footplate further including mounting holes which extend through the foot plate for mounting the device; and means for rotating the spool within the container.

2. The device of claim 1 wherein the mounting holes are spaced equidistantly about a perimeter of the foot plate.

3. The device of claim 1 wherein the elongate flexible member is an electrical cord and wherein the means for rotating the spool within the container comprise:

a bottom bearing member coupled to the base of the container;

a bottom bearing race coupled to the bottom bearing member, the bottom bearing race being made of an electrically conductive material;

a top bearing member coupled to the bottom of the spool;

a top bearing race coupled to the top bearing member, the top bearing race being made of an electrically conductive material;

bearing balls rotatably fitted between the bottom bearing race and the top bearing race;

a first electrical member electrically coupled to the bottom hearing race; and a second electrical member electrically coupled to the top bearing race.

4. The device of claim 3 further including:

means for sealing between the bottom bearing member and the top bearing member.

5. The device of claim 4 wherein the means for sealing comprises a gasket between the bottom bearing member and the top bearing member.

6. The device of claim 3 wherein the first electrical member comprises an electrical plug, and wherein the second electrical member comprises an electrical outlet.

7. A device for storing an elongate flexible member having a length, a first end and a second end, the device comprising:

a container having a base, a cylindrical sidewall, and a first access hole defined through the side wall;

a spool disposed within the container, the spool comprising:

a bottom freely resting within the container, a top having a second access hole extending therethrough, and a column vertically mounted between the top and bottom independent of the base, the column having a surface for winding the length of flexible member around, wherein the second end of the flexible member passes through the second access hole and wherein the first end of the flexible member passes through the first access hole of the container;

means for rotating the spool within the container; and means for retaining the spool vertically and concentrically within the container freely resting within the container so that the spool may be removed from the container as one piece.

8. A device for storing an elongate flexible member having a length, a first end and a second end, the device comprising:

a bucket having a base, a cylindrical sidewall and a hole extending through the sidewall;

a spool disposed within the bucket, the spool comprising:

a top plate having a top surface, a bottom surface, and a hole extending through the top plate from the top surface to the bottom surface;

a bottom plate having a top surface and a bottom surface;

a tube vertically mounted between the top plate and the bottom plate independent of the base and concentric with the hole in the top plate and having one end secured to the top surface of the bottom plate and the other end secured to the bottom surface of the top plate, the tube having an outer surface for winding the length of the flexible member around and a cavity enclosed by the outer surface extending from the outer surface to the hole of the top plate;

a bearing member secured to the bottom surface of the bottom plate and freely resting upon but not attached to the base of the bucket to allow the spool to be rotated within the bucket and to allow the spool to be lifted and removed from the bucket, and means coupled to the top plate for rotating the spool within the bucket, wherein the sidewall engages peripheral edges of the top plate and the bottom plate of the spool to concentrically and vertically retain the spool within the bucket during rotation of the spool and wherein the first end of the flexible member passes through the hole of the bucket, the length of the flexible member winds around the outer surface of the tube and the second end of the flexible member passes through the cavity and through the hole in the top plate of the spool.

9. A device for storing an elongate flexible member having a length, a first end and second end, the device comprising:

a container having a base, a sidewall and a first access hole extending through the sidewall;

a spool disposed within the container, the spool including:

a bottom freely resting upon but not attached to the base of the container to allow the spool to be rotated within the container and to allow the spool to be lifted and removed from the container;

a top having a second access hole extending therethrough; and a column vertically mounted between the top and the bottom independent of the base, the column having an outer perimeter for winding the length of flexible member around, wherein the first end of the flexible member passes through the second access hole, the length of the flexible member winds around the column and the second end of the flexible member passes through the first access hole of the container;

a footplate fixedly coupled to an exterior of the base of the container, wherein the footplate includes a substantially horizontal portion which extends beyond the sidewall of the container for stabilizing the container during rotation of the spool; and means for rotating the column within the container.

10. A device for storing an elongate flexible member having a length, a first end and a second end, the device comprising:

a bucket having a base, a cylindrical sidewall integrally extending upward from the base and a first access hole defined by the sidewall, and a handle coupled to the sidewall;

a spool disposed within the bucket, the spool comprising:

a bottom having a round bottom plate and bearing means coupled to the bottom plate for freely resting and supporting the spool upon the base so that the spool is free from attachment within the bucket to allow the spool to be rotated within the bucket and to allow the spool to be lifted and removed from the bucket, a round top plate having a second access hole extending therethrough, and a column vertically mounted between the round top plate and the round bottom plate independent of the base, the column having an outer surface for winding the length of flexible member around, wherein the round top plate retains the elongate flexible member concentrically around the outer surface of the column when the spool is within the bucket and when the spool is removed from the bucket and wherein the sidewall engages peripheral edges of both the round top and bottom plates of the spool to concentrically and vertically retain the spool within the bucket during rotation of the spool, wherein the second end of flexible member passes through the second access hole and wherein the first end of flexible member passes through the first access hole of the bucket; and means for rotating the spool within the bucket to wind the flexible member around the column.

11. The device of claim 10 wherein the first access hole of the bucket comprises an elongate slot extending through and along a substantial length of the side wall of the bucket from near the bottom plate to near the top plate of the spool to permit the flexible member to be wound substantially around the entire outer surface of the column.

12. The device of claim 10 further including compartments secured to the side wall of the bucket for holding tools.

13. The device of claim 10 further including an apron secured to the bucket, the apron having pockets for holding tools.

14. The device of claim 10 further including a compartment within the column for holding tools.

15. The device of claim 10 further including slits within the top of the bucket for holding tools.

16. The device of claim 10 further including means for releasably securing an end of the flexible member to the bucket.

17. The device of claim 16 wherein the means for releasably securing an end of the flexible member comprise slits within the side wall of the bucket.

18. The device of claim 10 further including a foot plate secured to an exterior the base of the bucket, wherein the footplate has a substantially horizontal portion extending beyond the sidewall so as to permit force to be applied to the foot plate for stabilizing the bucket during rotation of the spool.

19. The device of claim 10 wherein the elongate flexible member is a cord and wherein the first and second access holes have a circumference large enough to receive the cord through the first and second access holes.

20. The device of claim 10 wherein the top plate comprises a generally flat disk and wherein the second access hole extends through the disk.

21. The device of claim 20 wherein the top plate further includes a brace extending across the disk.

22. The device of claim 10 wherein the column further includes a cavity bounded by the outer surface extending from the outer surface to the second access hole, wherein the second end of the flexible member extends through the cavity and through the second access hole and wherein the first end of the flexible member extends therethrough the first access hole of the bucket.

23. The device of claim 10 wherein the means for rotating the spool within the bucket comprises:

a nut secured to the top of the spool for permitting the spool to be rotated with a nut driver.

24. The device of claim 10 wherein the means for rotating the spool comprises:

a bearing unit between the bottom of the spool and the base of the bucket; and a crank secured to the top plate of the spool.

25. The device of claim 24 wherein the crank is retractable.

* * * * *

UNITED STATES PATENT AND TRADEMARK OFFICE

CERTIFICATE OF CORRECTION

PATENT NO. : 5,915,641
DATED : June 29, 1999
INVENTOR(S) : Daniel A. Barberg

It is certified that error appears in the above-identified patent and that said Letters Patent is hereby corrected as shown below:

Title page,
Item [73], Assignee, delete “Mich.”, insert -- Minn. --.

Column 2,
Line 38, delete “FIGS.”, insert -- FIG. --.

Column 3,
Line 28, delete “may he”, insert -- maybe --.
Line 29, delete “spool may”, insert -- spool 18 may --.

Column 11,
Line 12, delete “exterior the”, insert -- exterior of the --.

Signed and Sealed this

Thirtieth Day of May, 2006

JON W. DUDAS
*Director of the United States Patent and Trademark Office*